US005297539A

United States Patent [19]

Liebl et al.

[11] Patent Number: 5,297,539

[45] Date of Patent: Mar. 29, 1994

[54] THERAPEUTIC DEVICE FOR CHIROPRACTIC DIAGNOSIS AND TREATMENT

[76] Inventors: Thomas J. Liebl; David J. Liebl, both of R.R. 1, Donnelly, Minn. 56235; Robert J. Jensen, 611 NE. Second Ave., Stewartville, Minn. 55976

[21] Appl. No.: 575,919

[22] Filed: Aug. 31, 1990

[51] Int. Cl.[5] ..... A47C 17/00

[52] U.S. Cl. ..... 601/26; 606/242; 5/618

[58] Field of Search ..... 128/68-75, 128/25 R, 25 B, 26; 269/322-325, 328; 272/134, 144; 606/238, 240-245; 5/600, 608, 612-613, 618, 652, 658

[56] References Cited

U.S. PATENT DOCUMENTS

| | | | |
|---|---|---|---|
| 1,166,018 | 12/1915 | Soresi . | |
| 1,582,950 | 5/1926 | Weaver et al. | 606/245 |
| 2,284,445 | 5/1942 | Pettit . | |
| 2,707,465 | 5/1955 | Nemeth . | |
| 2,764,150 | 9/1956 | Ettinger . | |
| 3,160,381 | 12/1964 | Langbaum . | |
| 3,302,641 | 2/1967 | Berne et al. | 606/245 |
| 3,916,882 | 11/1975 | Jameson . | |
| 4,061,137 | 12/1977 | Sandt . | |
| 4,379,450 | 4/1983 | Sjolinder | 606/243 |

*Primary Examiner*—Richard J. Apley
*Assistant Examiner*—Linda C. M. Dvorak
*Attorney, Agent, or Firm*—Patterson & Keough

[57] ABSTRACT

An automatic, therapeutic device is provided for treating spinal problems, including problems with intervertebral disks and spinal curvatures. The device is patient interactive, providing circumductive motion including oscillatory lateral flexion, rotation and longitudinal extension and compression of the spine. Patient supports and an adjustable, motor-driven articulated interconnection between the supports are provided, whereby rotation of the interconnection imparts circumducting motion to the patient's spine. The interconnection is a shaft formed by coaxial axles, including a hollow axle and a core axle received therein, which can be adjusted longitudinally relative to each other to adjust the degree of circumduction motion; the speed of rotation is also adjustable. Adjustments may be accomplished while the device is in use.

11 Claims, 7 Drawing Sheets

THERAPEUTIC DEVICE FOR CHIROPRACTIC DIAGNOSIS AND TREATMENT

TECHNICAL FIELD

The present invention relates to devices for biomechanical treatment of the human body. In particular, it relates to a therapeutic device for alleviating or solving problems involving the spine, especially the intervertebral disks and spinal curvatures.

BACKGROUND ART

Interest in physical wellbeing, research and interest in holistic concepts of treating disease and injury, and patient's increasing reluctance to undergo invasive surgical procedures have led to appreciation of the value of chiropractic and other holistic disciplines for the treatment of the human body. For treatment of spinal injury and for those wishing to maintain general health, particularly good condition of the spine and tone of the contiguous soft tissue structures, it may be advantageous to manipulate the spine to achieve better alignment of its component parts. Typically, this manipulation has been done, or is done, manually by a physical therapist or a doctor of chiropractic.

New diagnostic and treatment concepts have come into being as interest in and knowledge about chiropractic has increased. Treatments, such as flexion/distraction techniques, that normalize the biomechanics of the intervertebral disks and vertebral segments of the spine are one such area in which advances have occurred. The therapist or doctor traditionally has done all of the therapeutic manipulations, resulting in an inefficient use of treatment resources because some of the routine treatments could be done by machines. Some machines and devices are in use and improve the reproducability of manipulative treatment. An unmet need is to provide for the convenient, even controlled change in degree of machine manipulation, allowing for gentle or aggressive treatment as well as a progression therebetween while treatment is underway.

With particular regard to the desirability of easily controllable, variable machine manipulation of the spine, a device that would provide reproducable circumduction that can be increased or decreased safely, gradually and automatically while the device is in use would permit a treatment to start at one level of intensity and be increased or decreased to another level easily and automatically by a therapist or a therapist's assistant thereby enhancing a patient's comfort and the benefits of the treatment.

Therefore, it would be very advantageous for doctors of chiropractic and other therapists to have at their disposal a device which can provide automatic therapeutic manipulation, including circumductive motion of the spine, that could be readily adjusted or reset for the degree of manipulation, the speed of manipulation, and patient size, even while the device or machine is being used.

SUMMARY OF THE INVENTION

An automatic therapeutic device is provided for producing circumduction, a passive/active circular movement of a patient's spine, including compression and rotation, thereby treating the entire circumference of spinal disks and contiguous soft tissue around the spinal column. The present invention may be used for alleviating scoliosis, centering of intervertebral disks and treating multiple levels of disk herniations with rhythmic, controlled motion.

The device includes supports for a patient's pelvic area or lumbar spine and upper torso or cervical spine. These supports are arranged so the patient will be maintained in a generally prone position with legs and knees at a 60 to 90 degree angle. The cervical support is mounted on a telescoping, generally horizontal bracket so the position of the upper torso and cervical spine may be moved in a generally horizontal direction with respect to the pelvic or lumbar spine by extension or retraction of the bracket according to the patient's height. The bracket may be pivoted in a horizontal plane about a vertical axis, as well as about a longitudinally extending horizontal axis.

The pelvic and lumbar spine support includes a generally horizontal surface on which a patient can kneel and a generally vertical surface for abutting the patient's thighs. The pelvic lumbar support is operatively connected to a drive motor through an adjustable interconnecting shaft, whereby rotation of the shaft imparts circumducting motion to that support relative to the cervical support. Rotation of the shaft provides controlled, oscillating lateral flexion, rotation and extension/compression of the spine. The shaft comprises a pair of concentric axles, a hollow axle and solid, core axle. The two axles are adjustable relative to each other, whereby the degree of the circumducting motion may be increased or decreased according to the specific treatment needs.

The present invention provides reproducible circumduction that can be increased or decreased gradually and automatically while the device is in use, thereby allowing progression from or change to aggressive or gentle treatment depending upon the patient's needs. Because the device includes convenient operational controls and is automatic, it improves the efficiency and safety with which therapists and doctors treat patients. Additionally, the therapist may manually motion palpate or adjust the spine while the spine is undergoing circumductive action.

Other advantages of the present invention include the provision of reproducible treatment obtained under the guidance of a chiropractic assistant or other therapist without involving the direct supervision of a doctor of chiropractic. Patient comfort is enhanced by avoiding hyperflexion and encouraging natural lordosis. The patient is provided with a shut-off switch and, in fact, may become more involved in the treatment because the device includes active resistance features for use by the patient while undergoing treatment.

These and other advantages and objectives of the present invention will become apparent with reference to the drawings, the description of the preferred embodiment and the appended claims.

DETAILED DESCRIPTION OF THE PREFERRED EMBODIMENT

Figure 1:
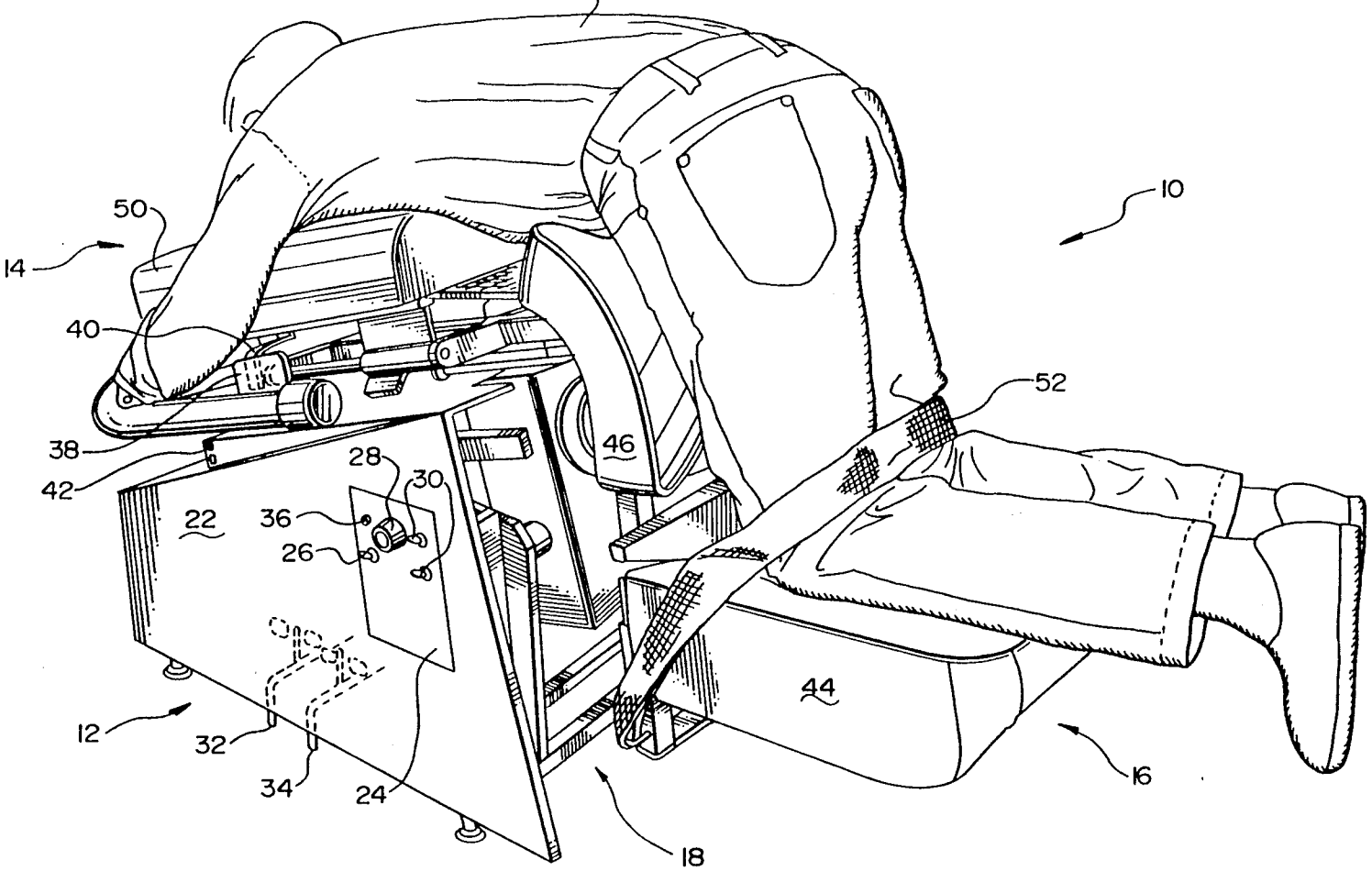
FIG. 1 is a perspective view of the present invention, and depicts a patient ready for treatment thereon.

Referring to the Figures, the therapeutic device or table 10 of the present invention is depicted and broadly comprises a frame and shroud assembly 12, a cervical support 14, and lumbar support 16 and a drive and attitude adjusting system 18. A patient P, ready for treatment on the therapeutic device 10, is depicted in FIG. 1.

Figure 2:
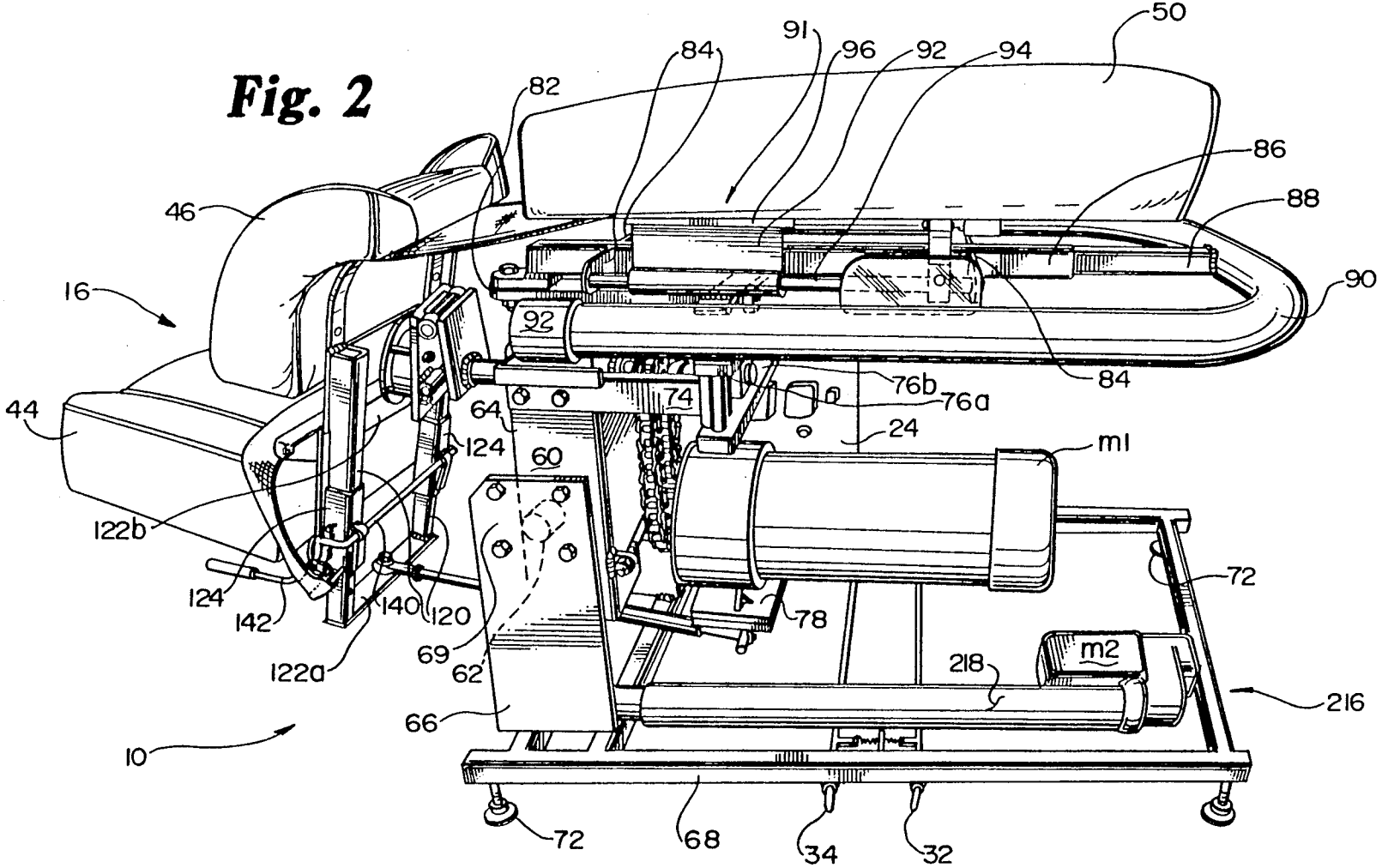
FIG. 2 is a perspective view of the present invention with the housing or cover omitted and depicts the side opposite the side shown in FIG. 1.

Details of the frame and shroud assembly 12 are provided in FIGS. 1 and 2. Specifically, FIG. 1 depicts one of the side covers 22 of the frame and shroud assembly 12. The cover 22 supports a control panel 24 having an off/on switch 26, a reostatic type speed control 28 and other hand actuation switches 30 for various adjustment features of the present invention explained below.

Additional control of operational states of the therapeutic device 10 are provided by the foot levers 32, 34. These levers 32, 34 are adapted to provide therapist or operator control of the therapeutic device 10 while maintaining their hands free. The control panel 24 may be provided with indicia indicating various operational parameters of the device 10 and it may be provided with LED or warning lights, exemplified by light 36, to provide additional information about functional states of the device 10 while treatment is underway.

Another control device for the therapeutic device 10 are bilateral emergency kill-switch paddles 38 connected to a kill switch 40. The paddles, 38, 40 and the switch are provided so that in the event of an emergency or extreme discomfort a patient may be able to stop the device quickly and safely. Because the therapeutic device 10 is able to achieve a multitude of attitudes and operational parameters as will be explained below, the frame and shroud assembly 12 may be provided with other indicia, exemplified by angle indicators 42. As suggested by FIGS. 1 and 2, it is not beyond the scope of the present invention that the frame and shroud assembly 12, and particularly the cover panels 22 thereof, may be removable for servicing should such service be required.

FIG. 1 illustrates how the cervical and lumbar supports 14, 16 respectively, are in contact with a patient P when the patient is positioned and ready for treatment. Specifically, a patient's knee and lower leg are shown in contact with kneeling pad 44. The thigh and general groin area of the patient P are in contact with the thigh pad 46. The patient's upper torso and upper arms are in contact with the torso pad 50. Webbing or a webbed strap or restraint 52 may be provided for safety.

Portions of the frame and shroud assembly 12 have been broken away in FIG. 2 so components thereof may be more easily apparent. The frame and shroud assembly 12 includes a central trunk 60 formed of plates in the shape of a generally rectangular, hollow central walled support. The trunk 60 is provided with bilateral trunions 62 at approximately the midpoint of each side wall 64 of the trunk 60. The trunions 62 are received in bilateral cheeks 66, which are in turn connected to the frame base 68. As with the central trunk 60, the cheeks 66 may be formed from appropriate materials including plate steel or suitably strong, rigid material. The trunions 62 may be received directly in the cheek 66 or, as depicted in FIG. 2, may be received in bearing mounts secured to the trunk 60. Feet 72 are provided at the bottom side of the frame base 68.

At the upper end of the central trunk 60, the therapeutic device 10 of the present invention includes a swing bracket 74. This swing bracket 74 is attached to the side wall 64 of the trunk 60 and plays a role in one of the attitude adjustments of the present invention 10 as will be explained herein below. The frame and shroud assembly 12 also includes various motor mounts 78 for supporting the attitude adjustment and drive motors of the present invention.

FIG. 2 illustrates that the present invention may have bilateral controls, that is, a control panel 24 may be provided on the cover 22 on either side of the device. Likewise, the foot switch levers or pedals 32, 34 may be provided on both sides of the present invention, whereby a therapist may operate the present invention with equal ease from either side thereof.

Figure 3:
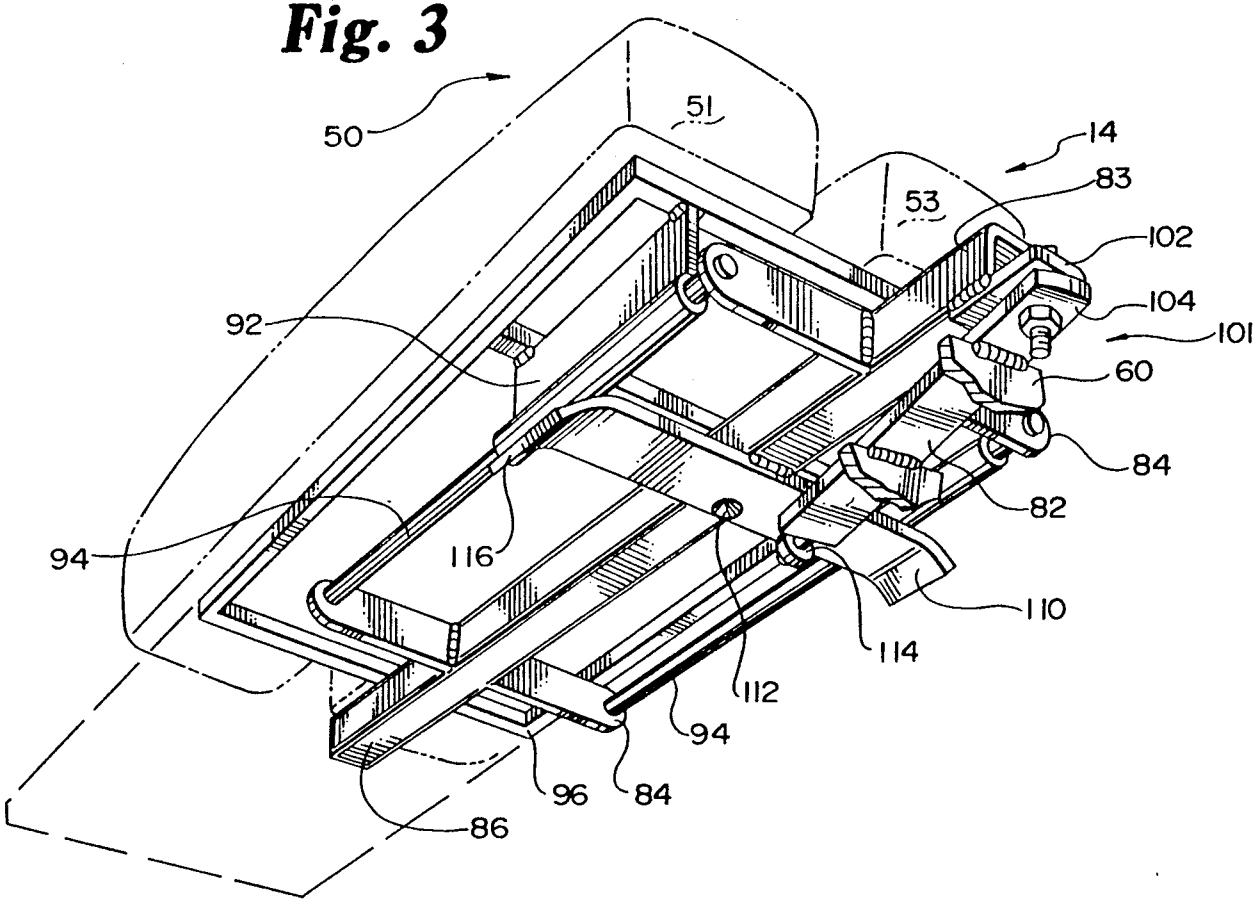
FIG. 3 is a bottom perspective view of the cervical support and subframe therefor depicting a first position thereof, a second position thereof being depicted in phantom lines.

The cervical support 14 is depicted in FIGS. 2 and 3. A mounting bar 82 is secured to the central trunk 60. The mounting bar 82 supports a torso branch 83 including bilateral front and rear track supports 84 and a generally medial member 86. The medial member 86 is a slide frame for slideably supporting a telescoping handlebar support 88. The handlebar support 88 is connected to and supports a generally U-shaped handlebar 90. The handlebar 90 includes enlarged safety ends 92 and is provided so that a patient P may grip the handlebar 90 with the hands H (as depicted in FIG. 1).

The bilateral track supports 84 support bilateral slides 92. The slides 92 travel on a pair of bilateral tracks 94 and are connected at their upper end to the torso pad frame 96. The frame 96 directly supports and is connected to the torso pad 50. The torso pad 50 is a split pad comprising pad sections 51 and 53.

FIG. 3 depicts the connection between the central trunk 60 and the cervical support 14. Specifically, the torso branch 83 has an ear 102 pivotally connected to one end 104 of the bar 82 fixed to the trunk 60. Any suitable means may be provided to connect the torso branch 83 to the end 104; for example, a nut and bolt arrangement as depicted in FIG. 3. The cervical support 14 pivots at this attachment point.

FIGS. 2 and 3, and particularly FIG. 3, depict that the cervical support 14 is adjustable laterally with respect to the frame and shroud assembly 12. A bilaterally extending wing 110 is affixed to the torso branch 86. The wing has a central detent 112. A roller 114 is pivotally connected to the end of the bar 82 and is in frictional contact with the wing 110. The wing 110 has curved 116 ends which act as roller stops to define the limits of side-to-side swinging lateral movement of the cervical support 14.

Figure 4:
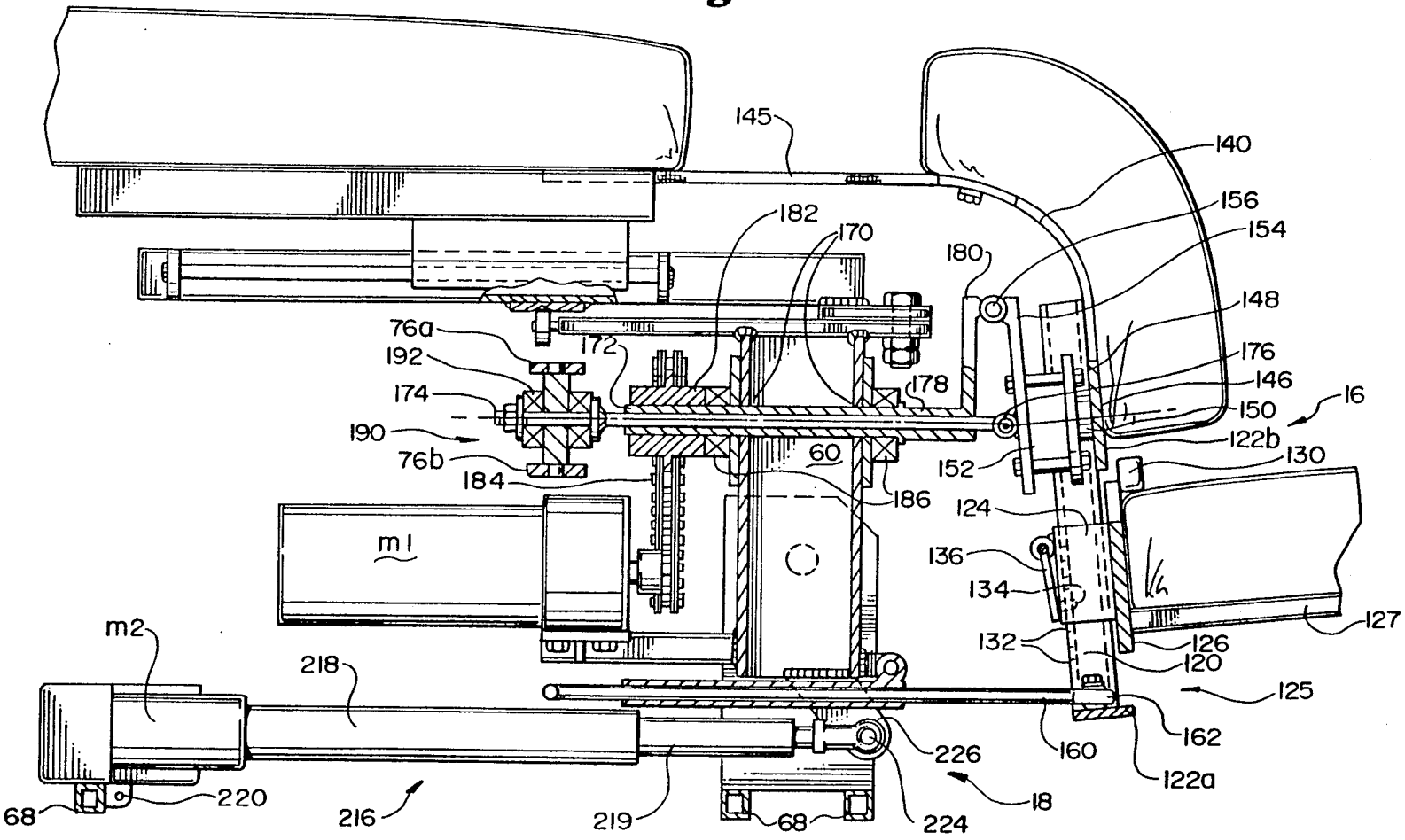
FIG. 4 is a right side, fragmentary elevation of the present invention with portions cut away for clarity.

The lumbar support 16 is depicted in FIGS. 2 and 4. A pair of generally tubular, bilateral kneeling frames 120 are connected by a pair of generally horizontal kneeling frame cross braces 122*a* and 122*b*. A pair of kneeling pad slides 124 are slideably mounting on the kneeling pad frames 120. Connected to the slides 124 is a kneeling pad frame 125 comprising a generally vertical member 126 attached directly to the slides 124 and a horizontal member 127 extending perpendicularly therefrom. The kneeling pad frame 125 directly supports the kneeling pad 44. A knee board 130 is provided to protect the knees of the patient while kneeling on the pad 44.

The lumbar support 16 is selectively and lockably adjustable relative to the kneeling frame 120 because the frame 120 is provided with the plurality of inline adjusting holes 132. The holes 132 are adapted to receive pins of 134 which may be positioned in the holes 132 by a pair a pin paddles 136 pivotally secured to the kneeling pad slides 124. The pin paddles may be secured by being welded to lever journals 138 which support a lever 140 attached to adjusting lever handle 142.

The thigh pad 46 is attached to the upper portion of kneeling frames 120 by means of thigh pad support plate 140. A fabric spring panel 145 is positioned between the torso pad 50 and the thigh pad 46 to ensure that clothing worn by the patient P does not extend downwardly between the two pads.

At the generally upper portion of the kneeling pad frames 120, cross brace 122*b* extends therebetween. The front side of 146 of the cross brace 122*b* abuts the thigh pad 46. Attached to the opposite, rear side 148 of the cross brace 122*b*, is a nonrotatable spindle 150. The spindle 150 is received in a pancake journal 152 by conventionable securing means, such as the bolts depicted, to a kneeling mount plate 154. The kneeling mount plate 154 is hingably connected to the drive and attitude adjustment system 18 by the hinge 156.

FIGS. 2 and 4 also depict that the device 10 is provided with a torsion control rod 160 linking the bottom cross brace 122*a* of the lumbar support 16 to the main motor mount 78 at ball joint 162.

Figure 5:
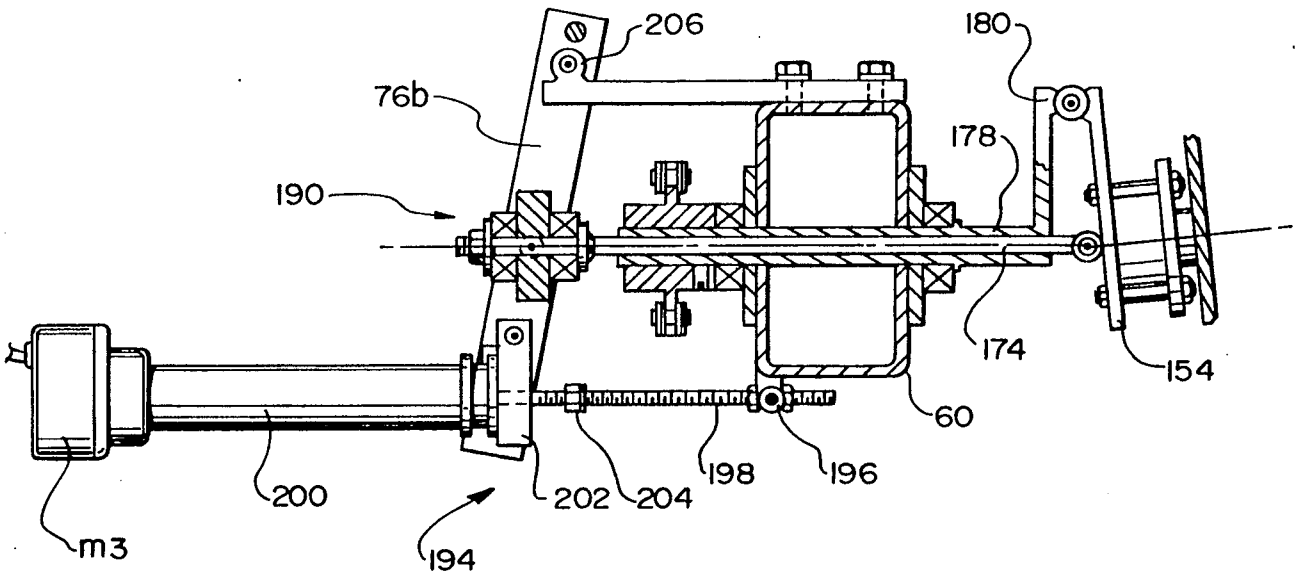
FIG. 5 is a top plan fragmentary view of the drive and attitude adjustment assembly of the present invention with portions cut away for clarity.
Figure 6:
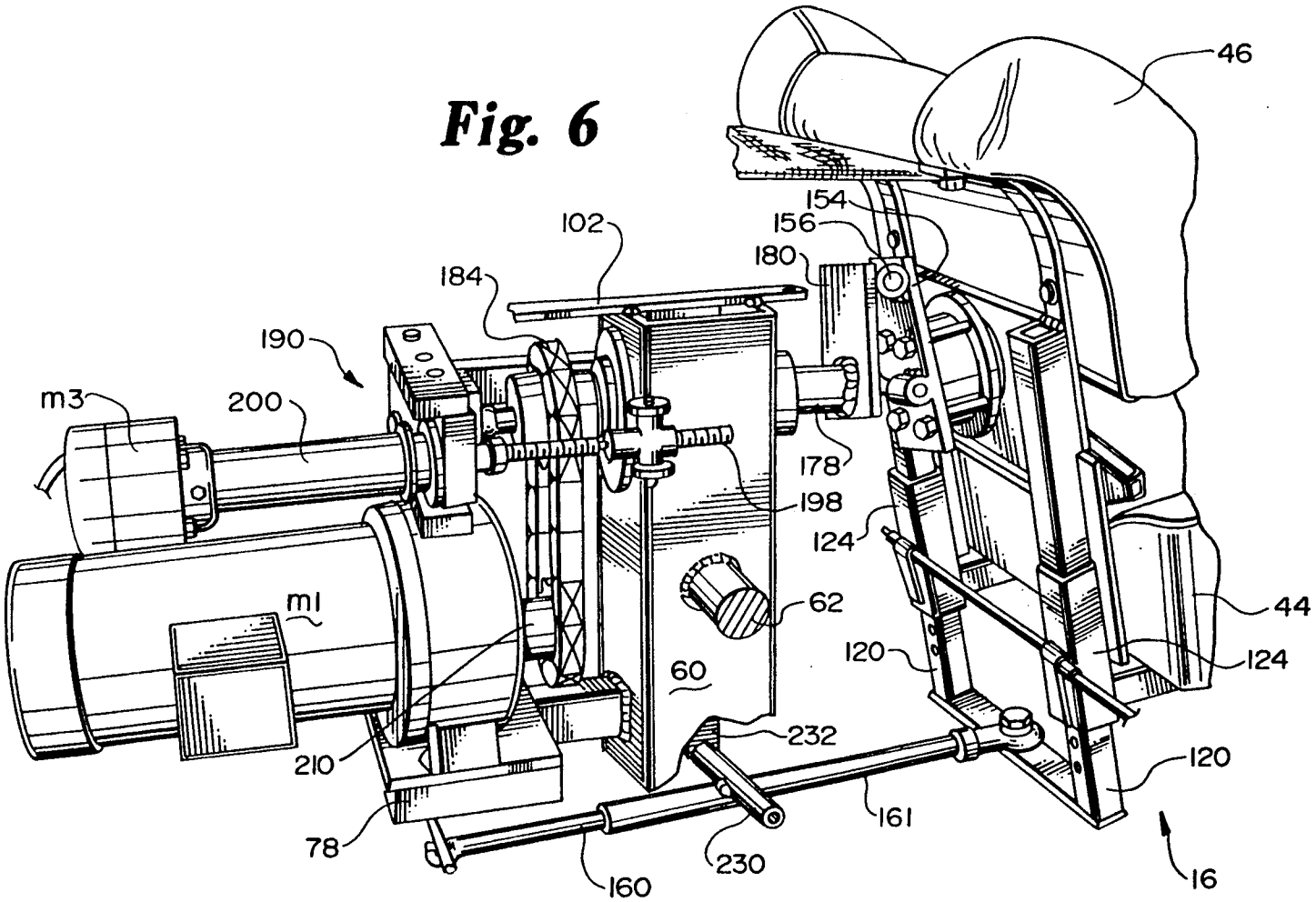
FIG. 6 is a fragmentary, left side perspective view of the present invention with portions cut away for clarity.

FIGS. 4, 5 and 6 depict the components of the drive and attitude adjustment system 18 of the therapeutic device 10. The system 18 provides the operative linkage between the drive motors m1, m2, m3, the patient supports 14, 16 and the frame and shroud assembly 12.

Near its upper end, the central trunk 60 is provided with a pair of aligned apertures adapted to receive an articulated, driving shaft interconnection 172 extending generally between electric motor m1 and the kneeling mount plate 154. The interconnection or shaft 172 is formed of a longitudinally extending, solid central core axle 174 connected to a core axle pivot 176 fixedly mounted to the kneeling mount plate 154.

The core axle 174 is received loosely in a eternal hollow axle 178. A first end of the hollow axle 178 terminates in the hollow axle plate 180 secured to a hinge 156 on the kneeling mount plate 154. The opposite end of the hollow axle 178 is provided with a sprocket 182 for receiving an endless drive chain 184. The interconnection shaft 172, comprised of axles 174 and 178, is rotatably supported by thrust bearings 186 connected to the central trunk 60.

The front end 173 of the central core axle 174 is connected to the kneeling mount plate 154 at core pivot 176. The opposite or rear end 175 of the axle 174 is rotatably received in a swing thrust block 190. The swing thrust block 190 is pivotally connected to the swing 76 which is made up of upper and lower swing members 76*a*, 76*b*. Thrust bearings 192 are provided to rotatably support the core axle 174.

FIG. 5 depicts the swing attitude adjustment means 194 attached to the central trunk 60 at a pivot junction 196. The adjustment means 194 includes a threaded ram 198 received in a swing linear actuator 200. The actuator 200 is secured to the swing members 76*a* and 76*b* by a mounting block 202 and may be driven by an electrical motor m3. A stop nut 204 is provided on the threaded ram 198 whereby a zero limit may be established.

FIG. 5 also depicts how the swing bracket 74 is attached to the central trunk 60 at one end thereof and is provided with a swing pivot 206 at the other end thereof. It should be appreciated that the threaded ram 198 and the motor driven swing actuator 200 exert an axial force in a generally horizontal plane toward or away from the direction of the lumbar support 16. The force specifically is exerted upon the core axle 174 slideably received in the hollow axle 178. The effect of actuating the actuator 200 is to advance or retreat the ram 198. FIG. 4 and 5 clearly depict that advancing the threaded ram 198 in the direction of the kneeling mount plate 154 will have the effect of increasing the distance and angle between and relative to the hollow axle plate 180 and the kneeling mount plate 154.

FIGS. 4 and 6 depict the mounting of motor m1 to the motor mount 78 connected to the central trunk 60. The continuous chain 184 extends between the driven shaft and pinion 210 on motor m1 and provides driving force to the sprocket 182 connected to the hollow axle 178.

FIGS. 2 and 4, and in particular FIG. 4, depict another attitude adjustment feature of the drive and attitude adjustment system 18 of the present invention 10. Specifically, a trunk linear actuator 216 is provided to selectively adjust the attitude of the central trunk 60 with respect to the generally horizontal base 68. A trunk linear actuator 218 is driven by motor m2 which may be pivotally mounted to base 68 at pivotal connection mount 220. At the opposite end of the linear actuator 218, a pivotal connection 224 is made to the central trunk 60. The pivotal connection 224 is operatively connected to the bell crank 226 contacting the bottom of the central trunk 60. When the linear actuator is actuated, it will advance or retreat the linear piston 219 either raising or lowering the central trunk 60. The raising and lowering of the central trunk 60 with respect to the frame base 68 has the effect of angling the cervical support 14 with respect to horizontal. Cervical support angle may be controlled by one of the foot switch levers 32, 34, being operatively connected to motor m2.

FIG. 6 depicts additional detail with regard to the torsion control rod 160. Specifically, it is connected to a sleeve axle 230, in turn connected to a pivot ear 232 near the base of the central trunk 60. The sleeve axle 230 is fixed to a sleeve 233 for receiving the rod 160.

Figure 7:
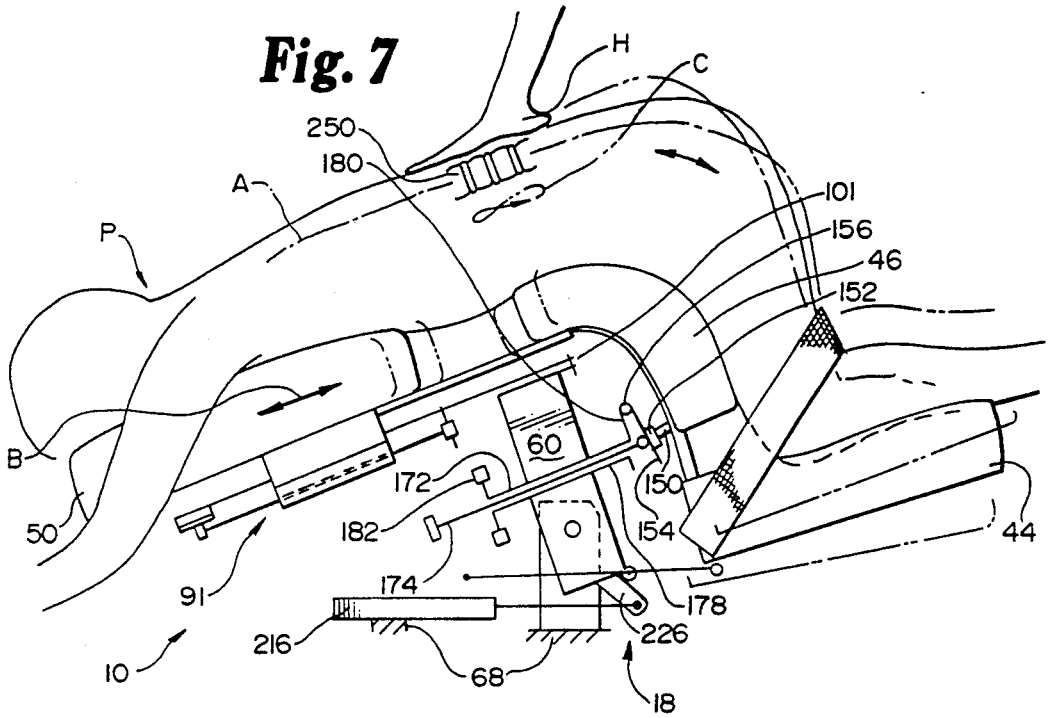
FIG. 7 is a right side elevational, largely schematic diagram depicting the operational actions of the present invention.
Figure 8:
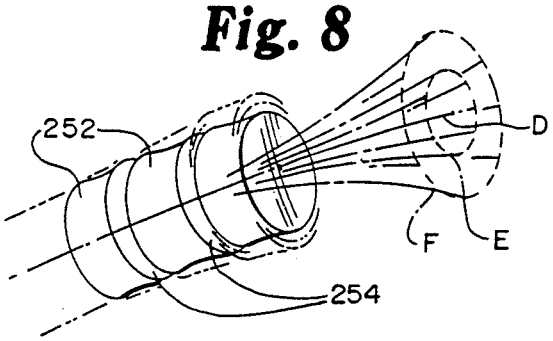
FIG. 8 is a perspective, representational diagram depicting a simplified spinal column with broken lines depicting motion thereof as provided by the present invention.

FIGS. 7 and 8 depict the dynamics of the therapeutic device 10, including the circumducting motion produced thereby and the range of adjustments which may be achieved by the drive and attitude adjustment system 18. In FIG. 7, a patient P is represented on the device 10 in position for treatment. The patient's spinal column 250 is represented, as well as the spinal center line, line A.

The components of the therapeutic device 10 are represented largely schematically and are commonly numbered with the preceding figures. The patient's upper torso is resting on the torso pad 50, the thighs are abutting the thigh pad 46, and the patient's lower leg is in contact with the kneeling pad 44.

With specific regard to the drive and attitude adjustment system 18, FIG. 7 depicts the central trunk 60 at an attitude angled from the vertical by the trunk linear actuator 216. The actuator has been moved to cause the bell crank 226 to impart an angle from vertical to the central trunk 60, thereby lowering the patient's head with respect to horizontal. At the upper end of the central trunk 60, the cervical support pivot 101 is represented. The pivot 101 provides for the lateral movement of the patient's upper torso. Additionally, arrow B depicts the longitudinal, generally horizontal movement of the torso pad 50 which may be achieved by the torso slide mechanism 91. This slide mechanism 91 is particularly useful in adjusting the therapeutic device 10 to accommodate persons of different height.

The interconnecting shaft 172 for providing the circumducting motion of the spine, represented by continuous arrow C, is depicted in FIG. 7 as well. The core axle 174 extends through the hollow axle 178; axle 178 terminates in a hollow axle plate 180. The plate 180 is connected by a hinge 156 to the kneeling mount plate 154. The mount plate pancake journal 152 rotatably receives the spindle 150 fixably connected to the kneeling frame cross brace **122*b***.

It should be appreciated that core axle 174 may be reciprocated within the hollow axle 178. The reciprocating motion of core axle 174 while connected to the kneeling mount plate 154 at the core pivot 176 changes the angular relationship between the cervical support 14 and the lumbar support 16 by pivoting the kneeling mount plate 154 about the hinge 156 connecting it to the hollow axle plate 180. This change in angular relationship is depicted in FIG. 7 by the phantom position of the lumbar support 16, and particularly the kneeling pad 44. It is this variable angular deflection which provide the changing compression in the circumducting motion C of the patient's spine 250.

The angular change is achieved by the swing 194 and the motor driven actuator 200 (see FIG. 5). Specifically, as the threaded ram 198 is extended or retracted the swing 194 enables or causes the core axle 174 to be extended or retracted along the longitudinal axis of the hollow axle 178. Because the core axle 174 is fixed to kneeling mount plate 154, the angular relationship between the cervical support 14 and the lumbar support 16 may be selectively varied.

FIG. 7 also depicts a therapist's hand in contact with the lumbar area of patient's spine 250. While the patient's spine 250 is being circumductively moved, the therapist may perform other manual adjustments to the spine or conveniently monitor the movement of the patient's spine.

In FIG. 8, the circumducting motion C is depicted by providing a schematic breakout of the spine 250, including phantom lines showing selected points from the range of spinal circumductive or flexure motion which may be achieved by therapeutic device 10. FIG. 8 depicts vertebrae 252 and the spinal discs 254 located therebetween. At point D, there is minimal or no circumductive or spinal axis flexion or compression. This would correspond to an adjustment of the adjustment system 18 wherein the core axle 174 is fully or nearly fully retracted into the hollow axle 178 bringing the hollow axle plate 180 and the kneeling mount plate 154 into close proximity.

At the intermediate circumductive motion or spinal axis flexure depicted at E, core axle 174 would be extended from hollow axle 178, thereby increasing the angle of kneeling mount plate 154 relative to the hollow axle plate 180.

Extreme circumductive or flexure motion of the spine and vertebrae is depicted at F in FIG. 8. To achieve this degree of motion, the core axle 174 may be extended by the swing mechanism 194 to its maximal or near maximal position rearwardly relative to the machine 10, thereby further increasing the angle between the hollow axle plate 180 and the kneeling mount plate 154.

Figure 9:
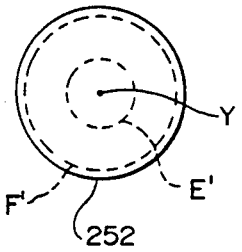
FIG. 9 is a simplified representation depicting additional detail of a spinal disk from FIG. 8.

FIG. 9 is a depiction of a simplified spinal disk 252 and is provided to illustrate the center line of the spinal column at point Y, the intermediate compression profile E' prime and the extreme compression profile F'.

In use, treatment procedures may outlined as follows. Initially, the patient kneels on the kneeling pad 44 so the therapist may determine the appropriate position of the kneeling pad 44 and move the kneeling pad slides 124 to ensure that the patient's thighs appropriately contact the thigh pad 46. Next, the patient bends forward so that the torso contacts the torso pad 50. That pad may be adjusted longitudinally along line B (depicted in FIG. 7) to accommodate the height of the patient.

The therapist or attendant may then adjust the cervical support 14 laterally by means of the cervical support pivot 101 and may adjust the patient's angle relative to horizontal by using the trunk linear actuator 216 controlled by the foot switch 34. Circumductive speed may be selected and adjusted using speed control knob 28.

The machine 10 may be switched on by off/on switch 26. The degree of circumductive motion or oscillation may be controlled by a therapist by using either switches provided on the control panel or a foot switch lever 32. The range of circumductive motion may be adjusted while the machine is on and, as depicted in FIG. 7, the therapist or attendant may palpate the patient's spine while a circumductive motion is being imparted thereto by the machine 10.

The device 10 disposes the patient in a kneeling position with the face and upper torso resting on the torso pad 50 and the hands grasping the handlebar 90. The position allows the lumbar spine 250 to remain in its natural lordotic position. The torso or cervical support 14 may be shifted laterally from right to left to accommodate the patient's antalgic lean or to enhance reduction of a scoliosis. The angular adjustment of the device 10 (specifically, the cervical support 14) relative to the horizontal may be adjusted to evenly distribute the patient's weight and the effects of gravity on spinal discs and surrounding tissues. The action of the device 10 (depicted as C in FIG. 7) continuously rotates the lower body in a controlled clockwise or counterclockwise direction. This motion administers a rhythmic traction and compression to the spine which can be further enhanced by having the patient push or pull on the handlebar 90. The circumduction administered may be increased or decreased to treat acute or chronic conditions aggressively or gently. Additionally, the foot switch levers 32, 34 free a therapist's hands for monitoring spinal movement while the movement is taking place or performing other treatments of the patient. The speed of rotation and the circumductive radius may be varied while the treatment is in progress.

The table 10 may be used for relieving muscle spasm, dissipating congested blood and may play a role in centralizing the nucleus pulposis in symptomic disc bulges.

It may also be used to treat mild disc protrusions. With controlled circumduction and alternating distraction, such compression is believed to enhance healing.

A number of variations of the present invention may be accomplished. Additional restraints may be provided and the configuration of the frame and shroud assembly 12, particularly the side covers 22 may be generally angular as depicted in FIG. 1 or more rounded. Additional control switches and operational indicators may be provided on the control panel 24 or on other portions of the device. Additionally, the machine base 68 may be provided with caster type feet whereby the machine may be moved to a selected location and then locked in place. Other changes within the scope of the present invention might include providing a cyclying or timing device incorporating heating or cooling therpeutic devices in the various pads for supporting a patient's body.

Although the description of the preferred embodiment has been presented, it is contemplated that various changes, including those mentioned above, could be made without deviating from the spirit of the present invention. It is therefore desired that the present embodiment be considered in all respects as illustrative, not restrictive, and that reference be made to the appended claims rather than to the foregoing description to indicate the scope of the invention.

What is claimed:

1. A therapeutic device for manipulation of selected body portions of a patient supported thereon, comprising:

a frame;

a first body portion support operably coupled to said frame, said first body support being adapted for supporting a first body portion of a patient;

a second body portion support operably coupled to said frame, said second body support being adapted for supporting a second body portion of a patient; and means operably coupling the first and second body portion supports for circumductive rotation therebetween, comprising hinge means for operably coupling said first body portion support in angular relationship with said second body portion support, said hinge means presenting a selectively adjustable hinge angle;

extensible drive means operably coupled to said hinge means for selectively adjusting said angle presented by said hinge means;

rotating drive means operably coupled to said hinge means for rotating said hinge means thereby circumductively changing the angular relationship between said first body portion support and said second body portion support; and bearing means operably isolating said extensible and rotating drive means for shifting of said extensible drive means independently of the rotation of said rotating drive means whereby said hinge angle is adjustable while said hinge means is rotating.

2. The therapeutic device as claimed in claim 1, said rotating drive means comprising a rotatable shaft member, said bearing means including a shaft member support means for operably, rotatably coupling said shaft member to said frame.

3. The therapeutic device as claimed in claim 2, said rotatable shaft member presenting a shaft member longitudinal axis, said extensible drive means including an extensible rod member shiftably carried by said rotatable shaft member generally along said shaft member longitudinal axis.

4. The therapeutic device as claimed in claim 3, said bearing means including means for rotatably supporting said extensible rod member for rotation of said extensible rod member with said shaft member.

5. The therapeutic device as claimed in claim 4, said extensible drive member including means for selectively shifting said rod member generally along said shaft member longitudinal axis.

6. The therapeutic device as claimed in claim 5, said shift member comprising a generally cylindrical tube, said rod member comprising an elongated rod shiftably received within said tube.

7. The therapeutic device as claimed in claim 1, said first body portion support being adapted to provide support for said patient's upper torso.

8. The therapeutic device as claimed in claim 7, said first body portion support including a generally horizontal first body portion support member for supporting said patient's upper torso in a generally prone position.

9. The therapeutic device as claimed in claim 8, including bracket means for supporting said generally horizontal first body portion support member on said frame whereby said first body portion support member is shiftable to accommodate patients of different heights and swingable to allow for side to side motion of said patient's upper torso.

10. The therapeutic device as claimed in claim 1, said second body portion support being adapted to provide support for said patient's pelvic area.

11. The therapeutic device as claimed in claim 10, said second body portion support including a generally horizontal surface adapted to knelt on by said patient, and a generally vertical surface adapted for abuttable engagement with said patient's thighs.

* * * * *